US005911226A

United States Patent [19]

Vecchiola et al.

[11] Patent Number: 5,911,226

[45] Date of Patent: Jun. 15, 1999

[54] TEMPERATURE INDICATING HAIR BRUSH

[76] Inventors: Michael Victor Vecchiola; Patricia M. Coyne, both of 23 White Pine Ave., Toronto, Ontario, Canada, M4B 2Z8

[21] Appl. No.: 09/064,117

[22] Filed: Apr. 20, 1998

Related U.S. Application Data

[63] Continuation-in-part of application No. 08/666,601, Jun. 18, 1996, abandoned.

[51] Int. Cl.[6] ..... A45D 7/00

[52] U.S. Cl. ..... 132/211; 15/168; 15/160; 132/162; 132/226

[58] Field of Search ..... 132/211, 150, 132/162, 163, 223, 226, 313, 122, 228, 237, 229, 120, 238, 245, 262; 15/168, 160, 164, 159.1, 206, 167.1, 27; D4/127, 128, 132, 133

[56] References Cited

U.S. PATENT DOCUMENTS

| | | | |
|---|---|---|---|
| 3,665,938 | 5/1972 | Pedersen | 132/233 |
| 3,878,580 | 4/1975 | Stohr et al. | 15/206 |
| 3,967,630 | 7/1976 | Zuhlsdorff et al. | 132/262 |
| 4,167,192 | 9/1979 | Arnold | 15/206 |
| 4,249,549 | 2/1981 | Cusenza | 132/228 |
| 4,344,763 | 8/1982 | Tolgyesi et al. | 132/203 |
| 4,416,297 | 11/1983 | Wolfram et al. | 424/70.17 |
| 4,425,161 | 1/1984 | Shibahashi et al. | 106/31.17 |
| 4,711,988 | 12/1987 | Thaler et al. | 219/364 |
| 5,318,052 | 6/1994 | Ivanov | 132/120 |
| 5,479,951 | 1/1996 | Denebeim | 132/120 |
| 5,606,983 | 3/1997 | Monty et al. | 132/233 |

FOREIGN PATENT DOCUMENTS

| | | | |
|---|---|---|---|
| 610072 | 8/1994 | European Pat. Off. | 15/167.1 |

*Primary Examiner*—Todd E. Manahan
*Assistant Examiner*—Eduardo C. Robert
*Attorney, Agent, or Firm*—Edward H. Oldham

[57] ABSTRACT

A hairbrush, the surface of which changes colour with temperature, is used to improve the set of human hair during a grooming process. The bristles of the brush may be of a colour temperature dependent nature as well as the surface on which the bristles are mounted or protrude.

9 Claims, 2 Drawing Sheets

TEMPERATURE INDICATING HAIR BRUSH

This application is a Continuation in part of U.S. application ser. No. 08/666,601 filed Jun. 18, 1996 now abandoned.

BACKGROUND OF THE INVENTION

Human hair has been brushed using brushes of various shapes and with a variety of bristles to shape, fashion and groom the hair since the beginning of time. In more recent times, hair grooming procedures have included adding fixatives to the hair and then employing devices useful in curling hair which tended to be straight, and or straightening hair which when left on its own tended to be curly. This application is extremely important to either of the above operations.

Before proceeding further, it is important to understand some of the important characteristics of human hair and terms that will be used throughout this disclosure.

It is well known that the physical characteristics of human hair change significantly with changes in the surrounding humidity. Human hair has long been used as the driving element in mechanical humidity gauges because of its extreme sensitivity to small changes in humidity.

In certain instances, the characteristics of human hair may be best understood by an analogy with spaghetti strings. When purchased by a consumer, spaghetti is most inelastic and of a set length. Upon immersion in water, the spaghetti will stretch significantly and if while in this state, the pliable spaghetti is wound around a collapsible mandrel and the pliable spaghetti is heated by some means when sufficient moisture is removed from the spaghetti and the previously pliable spaghetti is elevated to a predetermined temperature, the spaghetti may now be cooled and the mandrel on which it was wound, now collapsed and removed. The spaghetti will retain its "curled" configuration.

In a similar manner, curly hair may be curled and/or straightened. It is only a matter of combining moisture, fixatives, etc., heat and cooling to the hair to take advantage of the human hair's natural characteristics to obtain the desired "set" or other desirable grooming results.

An experienced professional hair designer will instinctively possess the "time recognition" required to know how and when to take advantage of these natural physical characteristics to obtain the desired styling result.

For instance, if a client is seeking a hairstyle which involves curling the hair, the experienced designer will begin with a client whose hair has been washed, properly conditioned, and to which the desired fixatives may have been applied, and whilst still wet selected locks of the wet hair are wound around a selected bristle brush and the hair so wound around the brush is heated to a temperature of between about 100°–110° F. by blowing hot air on the hair and brush until the designer instinctively recognizes that this temperature has been reached. During this period of time, the hair has decreased in length and begun its "set". The designer now begins to blow cold air on the hair and the brush to lower the temperature of the hair, and any fixatives applied to the hair (and the brush) to a temperature of about room temperature to complete the "set".

Similarly, to "straighten" what is generally referred to as naturally curly hair, the designer will choose a high density bristle brush, and taking a curl of hair previously washed and conditioned, and to which a suitable fixative may have been applied, wrap the curly hair (whilst still wet) around the high density brush and heat the hair and brush around which the hair is wound to about 150°–160° F. by blowing hot air from a hair dryer onto the hair and brush. The experienced hair designer will now begin to unroll the hair from the brush and while maintaining some tension on the hair with the high density brush, apply a cold stream of air to the hair as it just leaves the hot brush. This cold air completes the "set" and the previously curly hair will emerge from the process by now being straight. The hair emerges from the hot brush and is cooled as it emerges from the roll of bristles on the brush.

The experienced hair designer must be able to gauge the temperature of the hair (and the brush on which it is wound) from past experience to be able to consistently obtain the "best" results for the client. Years of experience are usually required to provide the necessary "time recognition" required to produce the desired result. The importance of cooling the hair to improve the "set" cannot be overstressed.

Definitions

"fixative"—a material applied to the hair (usually a polymer, copolymer or starch) in the form of a liquid or gel which is heat activated to provide body and set to the hair.

"time recognition"—the amount of time required to produce a given result which is instinctively known by one skilled in the art.

"curler"—a device used to curl the hair; it may be cylindrically shaped, and around which the hair is wound and which is fastened into the hair for some duration of time. Some "curlers" may contain an internal heat source.

"curling iron"—a device having an elongated heated shaft having a matching shaped "gate" (to fit around the shaft) which may be pivoted away from the shaft to permit a lock of hair to be placed between the gate and shaft. The gate is closed on the end of the lock of hair and entraps the hair sandwiched between the gate and the shaft. The hair is then wound around the closed curling iron (gate and shaft) and the internal heat from the iron "sets" the curl in the hair after the passage of time. The hair is unwound and the iron is removed.

"hairbrush"—defined in the Shorter Oxford Dictionary as "a toilet-brush for the hair".

SUMMARY OF THE INVENTION

It is to improve the skill of the hair designer and home consumer in obtaining the desired hair set that this invention is directed. Most curling instruments employed by professionals feature forminous cylinders through which the bristles project. This invention utilizes a hair brush where the hair contact surfaces of the brush have a surface the colour of which varies with the surface temperature of the brush. The bristles of the brush may be made to exhibit a colour change with temperature as well.

PERTINENT PRIOR ART

U.S. Pat. No. 4,469,934—Sep. 4,1984

U.S. Pat. No. 4,425,162—Jan. 10,1984

This patent describes a thermochromic material which is ideally suited to this invention. The invention disclosed in the above U.S. Patent has been disclosed for use in many appliances which are of the type having a heating element incorporated therein. The thermochromic material applied to such appliances provide the user with a signal that the device is "on". Mention is made of use in association with an electric pot, iron, toaster, drier, haircurler, electric blanket, electrically heated carpet, hot water heater, etc. but no mention of use on a passive device such as a hair brush. It is believed that the above patent teaches away from the invention contained herein.

BRIEF DESCRIPTION OF THE PREFERRED EMBODIMENT

Figure 1:
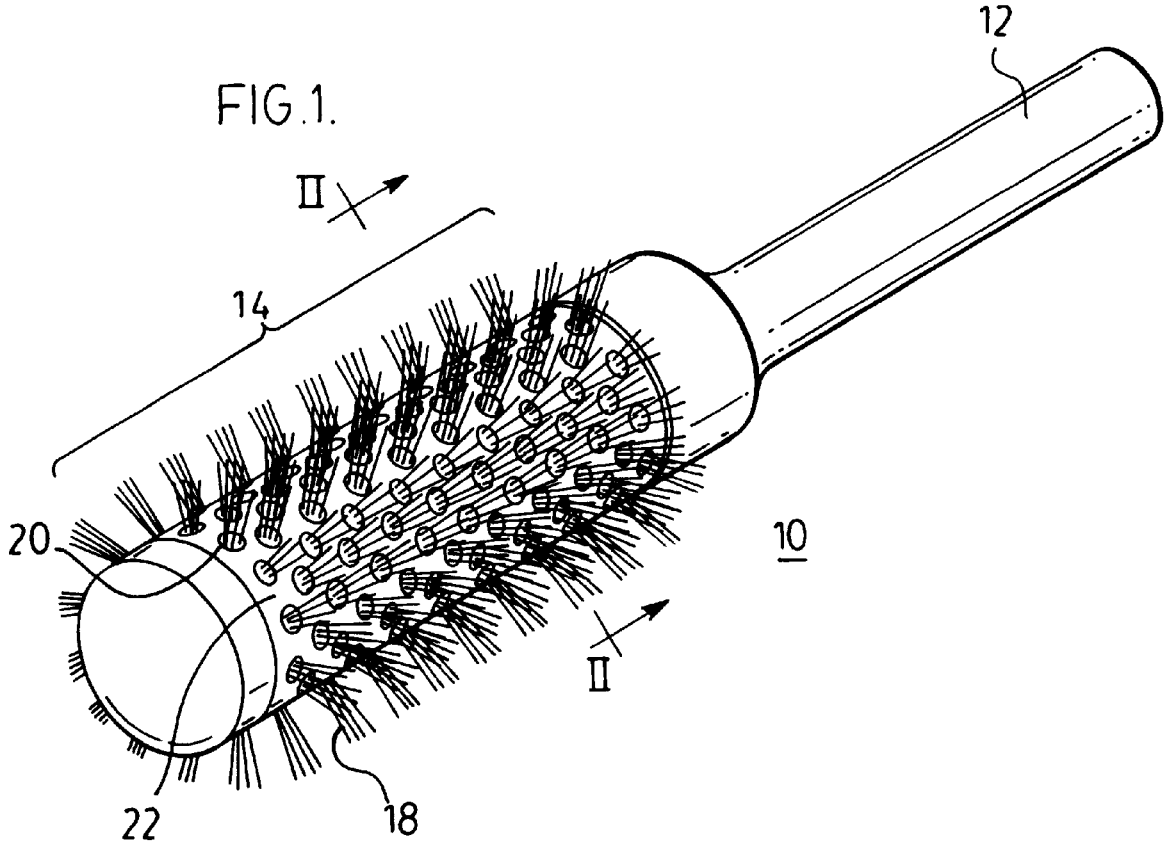
FIG. 1 is a perspective drawing of a hairbrush embodying applicant's invention.
Figure 2:
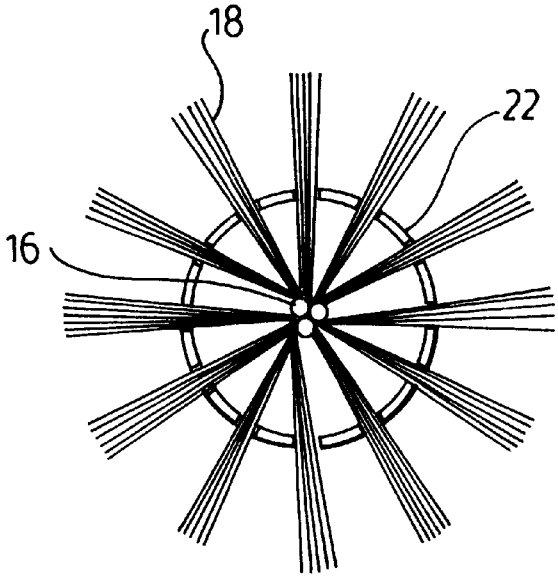
FIG. 2 is an end view of the brush of FIG. 1.

Referring to the attached drawings, a hairbrush 10 is shown having a handle 12 and a head 14. Head 14 is attached to handle 10 by any convenient means. Head 14 is shown having a central bristle carrier 16 (in this instance, twisted wire) on which bristles 18 are trapped. The bristles such as 18 are made to protrude through apertures 20 in cylinder 22. Cylinder 22 may be of any suitable material such as metal, wood or a plastic composition, but the surface of cylinder 22 is covered with a temperature-colour dependent heat sensitive material such as thermochromic material available from Matsui International Co. Inc. and sold under the trademark "Chromicolor". As stated previously, the bristles 18 may be coated with the same colour changing material.

Figure 3A:
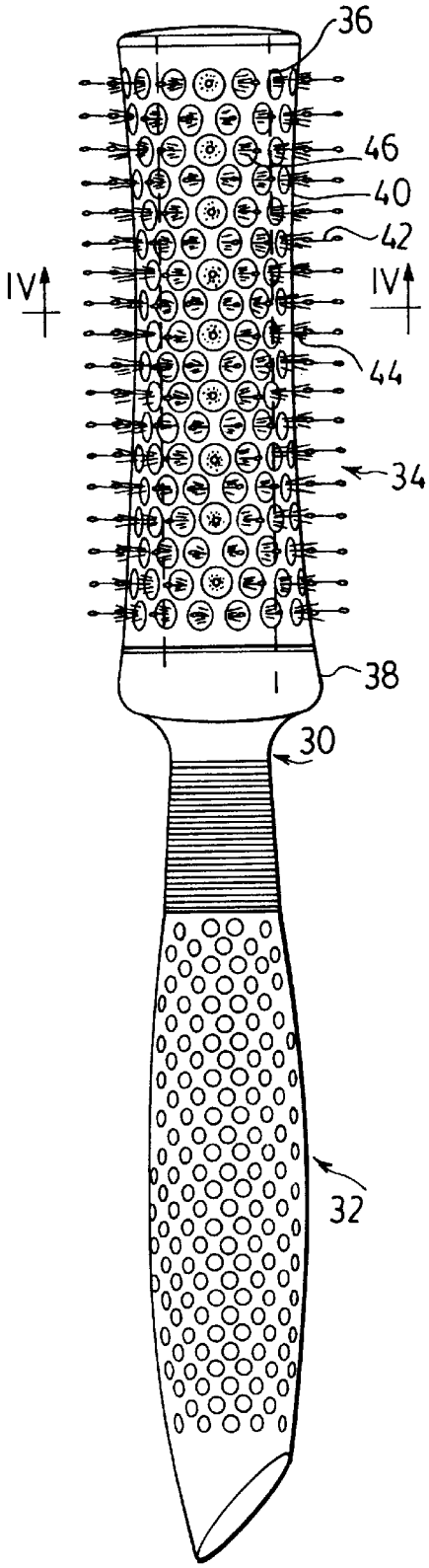
FIG. 3A is a view of an improved brush.

FIG. 3A shows a brush 30 having a handle 32 and a head 34. Handle 32 is a conventional handle having head 34 securely attached thereto. (Head 34 may be detachable to permit heads such as those shown in FIGS. 3B and 3C to be attached to handle 32.)

Head 34 comprises an inner cylinder 36 securely mounted in the base 38 of head 34, and an outer member 40 also mounted in base 38 of head 34 so as to be coaxial with cylinder 36. The exterior surface of member 40 is a surface of revolution which is concave at the center. The bristles 42 are preferably boar bristles and the bristles 44 are preferably of a plastic type and are firmly mounted in cylinder 36 and protrude through apertures such as 46 in member 40.

Figure 3B:
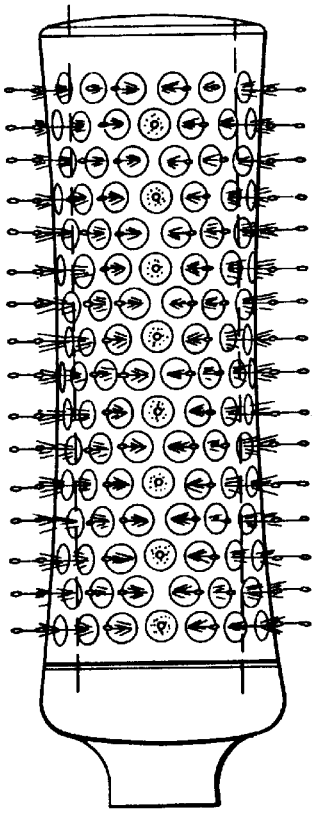
FIG. 3B shows an enlarged head brush.
Figure 3C:
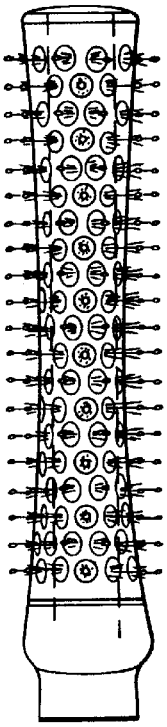
FIG. 3C is a small head brush.

FIGS. 3B and 3C show a head similar to the one shown in FIG. 3A except the size of the head is changed.

Figure 4:
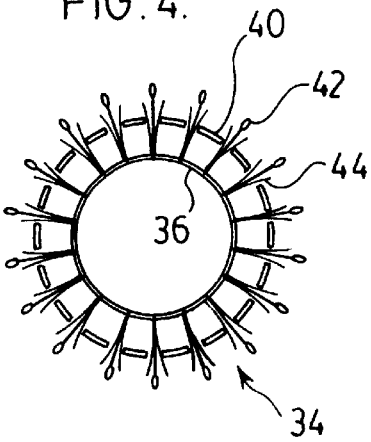
FIG. 4 is a section of the brush head of FIG. 3A.

FIG. 4 shows a sectional view of the brush head 34 of FIG. 3A showing the position of cylinder 36 and surface member 40.

Applicant has found that a hair styling brush which changes colour in the range of 100°–110° F. is very effective for providing a suitable form around which straight hair may be wound so that the hair may be curled. Also, a thermochromic material which charges colour in the range of 150°–160° F. will provide a hair stylist with a signal which makes it easier to determine when the curly hair wound on this surface is at an acceptable temperature for straightening. It will be understood that the above temperatures are not exact but are included for illustrative purposes only.

The brush illustrated in FIGS. 3A, 3B and 3C is an ideal tool for curling hair. After suitable fixatives have been applied to the wet hair, it is wrapped around the concave cylindrical head 34 where bristles 42 and 44 provide the necessary positioning and friction to guide the hair about the head 34. Hair does not tend to slip over the end of the brush and tangle on the end of the brush.

Heat is then applied to the brush and the hair wound around the head 34 until the head changes colour. Thereupon, the hair and brush may be cooled as previously to provide the "cool" set in the hair.

The construction of the brush 30 is ideally suited for the invention described. Because of the limited space between cylinder 36 and surface member 40 any heat applied to the hair wound around member 40 tends to be used to raise the temperature of the hair and surface member 40. The concave shape of member 40 tends to urge the hair to the center of the brush head 34, and prevent "fall off" the end of the brush.

While this invention will be a definite asset to the skilled professional hair designer, it will be seen by the amateur hair dresser as a tool for making easy work out of a previously difficult task. It is now possible to provide a brush which will tell the user when the temperature of the hair and brush have reached a level that will permit the hair to take on a definite set. At the same time, the brush will provide an indication that the hair and brush have cooled to the temperature at which the "set" becomes "permanent".

In this manner, the do-it-yourself hair stylist may now know accurately the temperature of the surface of the brush (and the enveloping hair) without having to guess the resultant temperature. In this manner, those less skilled in the art of hairdressing may now produce professional results without having elaborate equipment and prolonged experience in treatment of hair. Similarly, professional hair stylists may utilize the above brushes to educate their clients and save valuable time because of the absolute certainty of the temperature of the hair and brush. In this manner, their clients and save valuable time because of the absolute certainty of the temperature of the hair and brush. In this manner, the efficiency of each stylist may be increased and the embarrassment of an imperfect "set" may be avoided.

It will be found that any hair brush used for hairstyling could benefit from having a surface and/or bristles which provide a good indication of the surface temperature of the brush and bristles.

While changes to the invention are obvious once the principles of hair setting have been disclosed, applicant prefers to limit the ambit of protection by the scope of the following claims.

We claim:

1. A hairdressing brush for curling hair comprising a handle and an associated brush head, said head being attached to said handle and being in the form of a foraminous member having an outer shell which is a surface of revolution and wherein, bristles protrude from said foraminous member and, said surface of said shell exhibits a colour change when said shell is heated to a temperature in the range of about 100°–110° F.

2. A hairdressing brush as claimed in claim 1 wherein said bristles also exhibit a colour change with changing temperature in the same range.

3. A hairdressing brush as claimed in claim 1 wherein said surface is slightly concave.

4. A method of treating human hair comprising, providing a human head with hair growing therefrom, wetting said hair with water, selecting suitable locks of said hair for treatment, progressively winding said selected locks of hair about a hairbrush, the surface of which changes colour when said surface reaches a temperature in the range of about 100°–110° F. and heating said hair and hairbrush with a hairdryer until the surface of said brush changes colour, and subsequently blowing unheated air on said previously heated hair and brush until the hair and brush have cooled sufficiently to "set" said hair.

5. A method according to claim 4 wherein after wetting said hair, a suitable fixative is applied to said hair.

6. A method as claimed in claim 4 wherein said surface of said brush exhibits a second colour change when said brush reaches room temperature.

7. A method of treating human hair comprising, providing a human head with hair growing therefrom, wetting said hair with water, selecting suitable locks of said hair for treatment, progressively winding said selected locks of hair about a hairbrush, the surface of which changes colour when said surface reaches a temperature in the range of 150°–160° F., and heating said hair and hairbrush with a hairdryer until the surface of said brush changes colour, and subsequently blowing unheated air on said previously heated hair and brush until the hair and brush have cooled sufficiently to "set" said hair.

8. A method according to claim 7 wherein after wetting said hair, a suitable fixative is applied to said hair.

9. A method as claimed in claim 8 wherein said surface of said brush exhibits a second colour change when said brush reaches room temperature.

* * * * *